United States Patent [19]

Stone

[11] 3,942,638

[45] Mar. 9, 1976

[54] CAP ASSEMBLAGE FOR HARD SURFACE FLOOR COVERING ROLL AND METHOD FOR MAKING SAME

[76] Inventor: Harris E. Stone, 293 Lenox St., Norwood, Mass. 02068

[22] Filed: Mar. 14, 1975

[21] Appl. No.: 558,339

[52] U.S. Cl. ..... 206/416; 53/14; 206/410; 242/68.6

[51] Int. Cl.[2]B65B 61/00; B65D 85/66; B65H 17/02

[58] Field of Search.... 206/389, 408, 410, 413–416; 242/68.5–68.6; 53/14

[56] References Cited

UNITED STATES PATENTS

| | | | |
|---|---|---|---|
| 3,402,809 | 9/1968 | Snyder | 206/410 |
| 3,454,155 | 7/1969 | Voissem et al. | 206/408 |
| 3,458,032 | 7/1969 | Leibowitz et al. | 206/410 |
| 3,521,833 | 7/1970 | Ridgeway et al. | 242/68.6 X |
| 3,763,619 | 10/1973 | Stone | 242/68.6 UX |

*Primary Examiner*—William Price
*Assistant Examiner*—Steven E. Lipman
*Attorney, Agent, or Firm*—Morse, Altman, Oates & Bello

[57] ABSTRACT

A tubular paper core, about which a hard surface floor covering is coiled, is provided at its opposite ends with a pair of cap assembages, each of which includes inner and outer clamping disks and a collar, each disk formed with a central opening. The side margins of a web, which is wrapped about the floor covering roll, are crimped and glued to the exterior face of the inner disk and the interior face of the outer disk. The collar, which includes a tubular neck portion and an annular flange portion, is disposed between the disks, the flange portion being captively held between the disks and the neck portion being received within the opening formed in the inner disk and the tubular paper core.

10 Claims, 7 Drawing Figures

FIG. 1
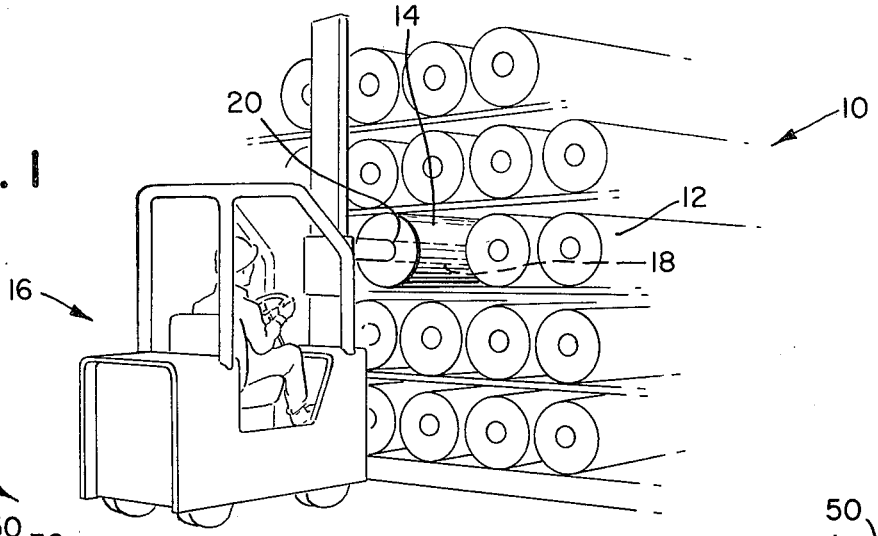
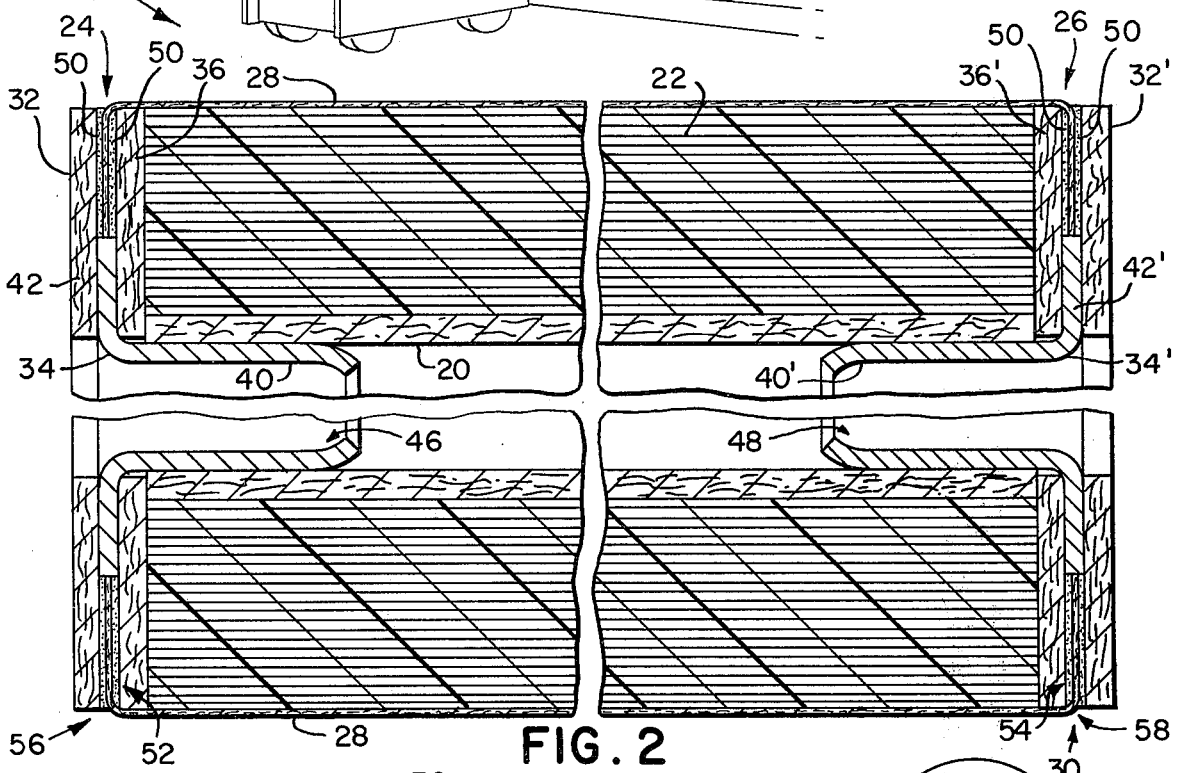
FIG. 2
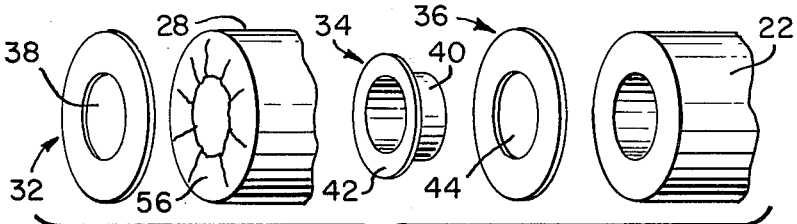
FIG. 3
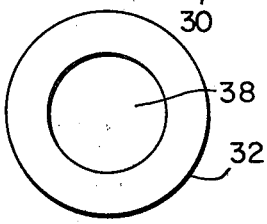
FIG. 4
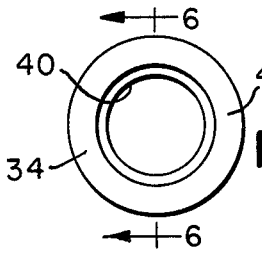
FIG. 5
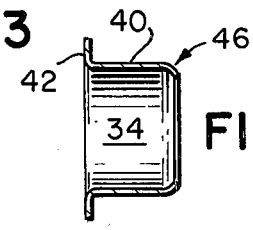
FIG. 6
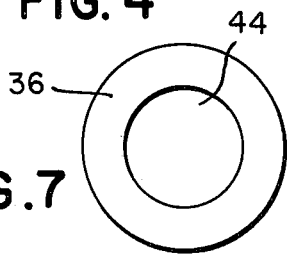
FIG. 7

CAP ASSEMBLAGE FOR HARD SURFACE FLOOR COVERING ROLL AND METHOD FOR MAKING SAME

BACKGROUND OF THE INVENTION

1. Field of Invention

The present invention relates to the wrapping an storage of hard surface floor coverings and, more particularly, is directed towards wrapping of hard surface floor covering rolls in such a way as to permit rack storage of the rolls.

2. Description of the Prior Art

Generally, hard surface floor covering, such as vinyl floor covering, are coiled in a roll about a tubular paper core that provided at its opposite ends with a cop. A connecting rod, which extends between the caps, is provided for holding the caps to the paper core. The purpose of the end caps and connecting rod is to hold the vinyl roll in tact and to prevent telescoping of the vinyl. In addition, since vinyl rolls generally are stored vertically on their ends, the end caps protect the vinyl edges. A vinyl roll is moved by tilting the roll on the edge of the cap and by wheeling the roll on the cap end. When a vinyl roll, which has a weight in the vicinity of 300 pounds, is moved in this manner, it has a tendency to tip. A need has arisen for improvements in hard surface floor covering rolls so that the rolls can be stored horizontally in storage racks.

SUMMARY OF THE INVENTION

It is an object of the present invention to provide, for a hard surface floor covering roll coiled about a tubular paper core and having an overwrap of paper, a pair of end cap assemblages, each of which includes an inner disk, a collar and an outer disk. Each disk is formed with a central opening and the collar includes a tubular neck portion and an annular flange portion. The inner disk abuts against the coiled edge of the floor covering roll. The tubular neck is inserted through the inner disk and into the paper core, the flange portion abuts against the exterior face of the inner disk. A suitable adhesive is applied to the exposed margins of the exterior face of the inner disk and the overwrap is crimped about and cemented to the inner disk. The adhesive is applied to the exposed crimped face of the overwrap and the outer disk is pressed against and cemented to the overwrap. The arrangement is such that the overwrap and collar flange are sandwiched between the inner and outer disks, which are coaxial with the longitudinal axis of the paper core. The central opening in the end cap assemblage is provided for lifting and for horizontally storing the floor covering roll in a storage rack.

Other objects of the present invention will in part be obvious and will in part appear hereinafter.

The invention accordingly comprises the devices and processes, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description, taken in connection with the accompanying drawings, wherein:

FIG. 1 is a perspective view of a plurality of hard surface floor covering rolls stored horizontally in a storage rack and a fork lift for removing the rolls from the rack;

FIG. 2 is a cross section of a hard surface floor covering roll embodying the invention, the cross section being taken in a vertical plane through the axis of the roll core;

FIG. 3 is an exploded view in perspective of a cap assemblage, overwrap and hard surface floor covering roll embodying the present invention;

FIG. 4 is a front plan view of the outer disk of the cap assemblage of FIG. 3;

FIG. 5 is a front plan view of the collar of the cap assemblage of FIG. 3;

FIG. 6 is a section taken along the lines 6—6 of FIG.5; and

FIG. 7 is a front plan view of the inner disk of the cap assemblage of FIG. 3.

DETAILED DESCRIPTION OF THE PREFERRED EMBODIMENTS

Referring now to the drawings, particularly FIG. 1 there is shown a storage rack 10 in which a plurality of hard surface floor covering rolls 12 are stored horizontally. One of the rolls is shown at 14 being withdrawn from storage rack 10 by a prod truck 16, which has a stake 18 that projects into a paper core 20 of the roll. The prod truck thereby can remove rolls 12 from storage rack 10 or can insert the rolls into the storage rack, the rolls being stored horizontally.

FIG. 2 illustrates a cross section of one hard surface floor covering roll 12, which comprises paper core 20 in the form of an elongated hollow cylinder, a hard surface floor covering 22, and a pair of end cap assemblages 24 and 26. Successive convolutions of hard surface floor covering 22, for example a vinyl floor covering, envelope core 20. A sheet of an overwrap 28, for example a sheet of kraft paper, plastic film or tyvek, is wrapped about vinyl roll 12 and its edge margins are crimped at 28 and 30 about the ends of the roll. The crimped margins are secured in end cap assemblages 24 and 26.

With reference to FIGS. 3, 4, 5, 6, and 7, end cap assemblage 24 includes an outer disk 32, a collar 34, and an inner disk 36. Outer disk 32, which is formed with a central opening 38 having a diameter in the range of 8.5 cm to 12.5 cm (3.5 inches to 5.0 inches) is composed of a heavy sheet material such as fiberboard. Disk 32 has a diameter in the range of 25.4 cm to 37.1 cm (10.0 inches to 15.0 inches) and a thickness in the range of 0.2 cm to 1.0 cm (0.08 inches of 0.39 inches). Collar 34, which is composed of a metal such as steel, for example a low-carbon steel having 0.15 percent to 0.30 percent carbon, includes a tubular neck portion 40 and an annular flange portion 42. Flange portion 42, which has inner and outer circular peripheries, is disposed in a plane perpendicular to the longitudinal axis of neck portion 40, which extends from the inner periphery of the flange portion. The outside diameter of neck portion 40 is approximately 0.01 cm to 0.5 cm (0.004 inches to 0.20 inches) less than the diameter of opening 38 of outer disk 32 and the diameter of flange portion 42 is approximately 1.0 cm to 20.3 cm (0.39 inches to 8.0 inches) larger than the diameter of opening 38. The length of neck 40 is in the range of 2.5 cm to 12.7 cm (1.0 inches to 5.0 inches). In the illustrated embodiment, by way of example, coller 34 is formed by a stamping process, the thickness of the steel being in the range of 0.05 cm to 0.37 cm (0.02 inches to 0.15 inches). Inner disk 36 is substantially similar in construction to outer disk 32 and is formed with a central opening 44. End cap assemblage 26 is a mirror image of end cap assemblage 24, corresponding components denoted by like reference characters and distinguished by a primed notation. That is, end cap assemblage 26 includes outer disk 32', collar 34', and inner disk 36', which correspond to outer disk 32 collar 34, and inner disk 36, respectively, of end cap assemblage 24. Similarly, collar 34' includes a tubular neck portion 40' and an annular flange portion 42' which correspond to neck portion 40 and flange portion 42 of collar 34.

In operation, a hard surface floor covering, particularly a vinyl floor covering is convoluted about paper core 20 to form vinyl roll 12 that has a side-to-side or width dimension of approximately 183.8 cm (72.375 inches). The inside diameter of paper core 20 is in the range of 7.6 cm to 15.2 cm (3.5 inches to 6.0 inches) and the outside diameter of the paper core is in the range of 10.9 cm to 11.9 cm (4.3 inches to 4.7 inches), the length of the paper core being substantially equal to the width of the vinyl roll. In the illustrated embodiment, by way of example, the inside and outside diameters of paper core 20 are 10.5 cm (4.124 inches) and 11.4 cm (4.5 inches), respectively. Neck 40 of collar 34 is inserted through opening 44 of inner disk 36 and is pressed into paper core 20. The inside face of disk 36 abuts against the side edges of the vinyl and the inside face of disk 36. In a similar manner, disk 36' and collar 36' are fitted to the opposite end of the vinyl roll. In order to facilitate insertion of necks 40 and 40' into paper core 20, the leading edge of each neck is bent or tapered inwardly as shown at 46 and 48, respectively. Thereafter, overwrap 28, for example kraft paper, is convoluted about vinyl roll 12, typically three convolutions, the margins of the kraft paper extending beyond the edges of the vinyl roll. Next, an adhesive 50, for example a hot melt adhesive is applied to the outside face of disks 36 and 36' at 52 and 54, respectively. Hot melt adhesive 50 is composed of non-volatile thermoplastic materials, for example a polymer such as polyethylene, polyvinyl acetate and ethylene-vinyl acetate copolymers, and a diluent such as wax, plasticizer, tackifying or plasticizing resin like wood rosin, rosin esters, stabilizers. Although it is preferred that kraft paper 28 is convoluted about vinyl roll 12 prior to application of adhesive 50, in an alternate embodiment, the adhesive is added to disks 36 and 36' and then the kraft paper is convoluted about the vinyl roll. Next, kraft paper 28 is crimped about disks 36 and 36' at 56 and 58, respectively. Next, adhesive 50 is applied to the faces of kraft paper 38 at the crimped margins opposite the adhesive shown at 52 and 54. In an alternate embodiment, adhesive 50 is applied to disk 32. Finally, disk 32 is pressed against the crimped margins of kraft paper 28 and the outside periphery of flange portion 42. Outer disks 32 and 32' collars 34 and 34', and inner disks 36 and 36' are coaxial with the longitudinal axis of paper core 20, the outer periphy of innner disk 32 being in registration with the outer periphery of outer disk 36 and the outer periphery of inner disk 32' being in registration with the outer periphery of outer disk 36'. Outer disks 32 and 32' flanges 42 and 42' and inner disks 36 and 36' are disposed in a plane perpendicular to the longitudinal axis of paper core 20. From the foregoing, it will be appreciated that kraft paper 28 and flange 42 are sandwiched between disks 32 and 36, and are captively held by adhesive 50, neck 40 being snugly received within paper core 20. Similarly, kraft paper 28 and flange 42' are sandwiched between disks 32' and 36', and are captively held by adhesive 50, neck 40' being snugly received within paper core 20. End cap assembages 24 and 26 are held in position at opposite ends of the linoleum roll by kraft paper 28. After the end cap assemblages are in place, the vinyl rolls can be inserted horizontally in storage rack 10 and can be removed therefrom by means of prod truck 16. In addition, in the event that the vinyl rolls are wheeled on their ends, end cap assemblages 24 and 26 protect the edges of the vinyl from damage and prevent telescoping of the roll.

Since certain changes may be made in the foregoing disclosure without departing from the scope of the invention herein involved, it is intended that all matter contained in the foregoing description and shown in the accompanying drawings be construed in an illustrative and not in a limiting sense.

What is claimed is:

1. A cap assemblage for a hard surface floor covering roll constituting a hard surface floor covering convoluted about a paper core and an overwrap enveloped about the convoluted hard surface floor covering, said cap assemblage comprising:

a. a pair of disks, one of said disks being an inner disk and the other of said disks being an outer disk, each said disk formed with a central opening, each said disk having inner and outer faces;

b. a collar including an annular flange portion and a tubular neck portion, said flange portion having inner and outer faces and inner and outer circular peripheries, said neck portion extending from the inner periphery of said flange portion, said neck portion being received within said inner disk central opening and within said paper core, the diametral profile of said outer periphery of said flange portion being larger than the diametral profile of said inner disk central opening and the diametral profile of said outer disk central opening;

c. said cap assemblage said fitted to said hard surface floor covering roll, said inner face of said inner disk abutting against an edge of the convoluted floor covering, said neck portion being received within said inner disk central opening and within the paper core, said inner face of said flange portion abutting against said outer face of said inner disk, said inner face of said outer disk abutting against said outer face of said flange portion, and the said overwrap being sandwiched between said outer face of said inner disk and said inner face of said outer disk.

2. The cap assemblage as claimed in claim 1 wherein the diameter of each said disk is approximately equal to the diameter of the convoluted hard surface floor covering roll.

3. The cap assemblage as claimed in claim 1 wherein the extending end of said neck portion is tapered inwardly towards the longitudinal axis of said neck portion.

4. The cap assemblage as claimed in claim 1 wherein each said disk is composed of a heavy sheet material.

5. The cap assemblage as claimed in claim 4 wherein said collar is composed of low-carbon steel.

6. The cap assemblage as claimed in claim 1 wherein the diameter of each said disk is in the range of 25.4 cm to 37.1 cm and the diameter of each said central opening is in the range of 8.5 cm to 12.5 cm.

7. The cap assemblage as claimed in claim 6 wherein the outside diameter of said neck portion is approximately 0.01 cm to 0.5 cm smaller than the diameter of each said central opening and the diametral profile of said outer periphery of said flange portion is approximately 1.0 cm to 20.3 cm larger than the diameter of each said central opening.

8. A method for storing hard surface floor covering, said method comprising the steps of coiling a hard surface floor covering about a tubular paper core to form a hard surface floor covering roll, pressing a collar and inner disk against each end of the hard surface floor covering roll, each said collar having an annular flange portion and a tubular neck portion extending from said flange portion, each said inner disk formed with a central opening that is adapted to receive said neck portion, an inner face of each said inner disk abutting against one end of said hard surface floor covering roll, each said flange portion abutting against an outer face of each said inner disk, each said neck portion received within the central opening of its associated disk and within the tubular paper core, applying an adhesive to the exposed outer face of each said inner disk, wrapping a sheet about said hard surface floor covering roll, crimping the ends of said sheet about the exposed outer faces of each said inner disk having said adhesive applied thereto, applying said adhesive to the exposed crimped regions of said sheet, and pressing an outer disk against each said crimped region of said sheet having said adhesive applied thereto, an inner face of each said outer disk abutting against the outer face of one of said flange portions, said adhesive holding said inner disks and said outer disks in fixed relationship, said central openings being coaxial with a longitudinal axis of said paper core.

9. The method as claimed in claim 8 wherein said adhesive is composed of nonvolatile thermoplastic material.

10. The method as claimed in claim 9 wherein said nonvolatile thermoplastic material is a polymer and a diluent.

* * * * *